US009151050B2

(12) United States Patent
Santeramo

(10) Patent No.: US 9,151,050 B2
(45) Date of Patent: Oct. 6, 2015

(54) SPLICE PLATE

(71) Applicant: John Santeramo, Bloomfield, NJ (US)

(72) Inventor: John Santeramo, Bloomfield, NJ (US)

( * ) Notice: Subject to any disclaimer, the term of this patent is extended or adjusted under 35 U.S.C. 154(b) by 0 days.

(21) Appl. No.: 14/164,630

(22) Filed: Jan. 27, 2014

(65) Prior Publication Data

US 2014/0140760 A1 May 22, 2014

Related U.S. Application Data

(63) Continuation-in-part of application No. 13/343,685, filed on Jan. 4, 2012, now abandoned.

(51) Int. Cl.
*E04B 9/18* (2006.01)
*E04B 9/10* (2006.01)

(52) U.S. Cl.
CPC . *E04B 9/10* (2013.01); *Y10T 403/70* (2015.01)

(58) Field of Classification Search
CPC ..... E04B 9/10; E04B 9/127; E04B 9/068
USPC ..... 52/506.07, 712, 715, 665
See application file for complete search history.

(56) References Cited

U.S. PATENT DOCUMENTS

| | | | | |
|---|---|---|---|---|
| 3,216,537 | A * | 11/1965 | Nels | 403/219 |
| 3,284,977 | A | 11/1966 | Lickliter et al. | |
| 3,329,387 | A * | 7/1967 | Fischer | 248/342 |
| 3,871,150 | A | 3/1975 | Murray et al. | |
| 4,108,563 | A | 8/1978 | Brown et al. | |
| 4,314,432 | A | 2/1982 | Rosenbaum | |
| 4,335,973 | A | 6/1982 | Beck et al. | |
| 4,580,387 | A | 4/1986 | Rogers | |
| 4,583,340 | A * | 4/1986 | Sauer | 52/506.07 |
| 4,640,075 | A * | 2/1987 | Nuncio | 52/506.06 |
| 4,724,650 | A | 2/1988 | Carey et al. | |
| 5,349,800 | A * | 9/1994 | Peng | 52/506.06 |
| 5,619,833 | A * | 4/1997 | Neff | 52/506.07 |
| 5,941,029 | A * | 8/1999 | MacLeod | 52/167.1 |
| 6,178,712 | B1 | 1/2001 | Sauer | |
| 6,199,343 | B1 | 3/2001 | Sauer et al. | |
| 6,305,139 | B1 | 10/2001 | Sauer | |
| 6,523,313 | B2 | 2/2003 | Lin et al. | |
| 6,729,100 | B2 | 5/2004 | Koski et al. | |
| 6,892,500 | B2 * | 5/2005 | Zaborowski | 52/506.06 |
| 6,957,517 | B2 | 10/2005 | Auriemma | |
| 7,062,886 | B2 * | 6/2006 | Auriemma | 52/506.07 |
| 7,293,393 | B2 | 11/2007 | Kelly et al. | |
| 7,614,195 | B2 | 11/2009 | Platt et al. | |
| 7,661,236 | B2 | 2/2010 | Platt et al. | |

(Continued)

FOREIGN PATENT DOCUMENTS

| | | |
|---|---|---|
| CA | 1065572 | 11/1979 |
| EP | 1553239 | 7/2005 |

(Continued)

OTHER PUBLICATIONS

Donn Brand Suspension Systems Accessory Product Guide, 2006.

*Primary Examiner* — Elizabeth A Plummer
(74) *Attorney, Agent, or Firm* — Greenberg Traurig, LLP

(57) ABSTRACT

The present invention provides a splice plate suitable for use in joining beams for use in a grid that supports panels and ceiling fixtures in a suspended ceiling. In particular, the present invention provides a splice plate suitable for use in joining main beams together for use in a grid that supports panels and ceiling fixtures in a suspended ceiling.

4 Claims, 12 Drawing Sheets

(56) References Cited

U.S. PATENT DOCUMENTS

| | | | |
|---|---|---|---|
| 7,673,429 | B2 | 3/2010 | Frecska |
| 7,770,349 | B2 | 8/2010 | Tedesco et al. |
| 7,788,872 | B2 | 9/2010 | Platt |
| 2002/0124496 | A1 | 9/2002 | Lin et al. |
| 2005/0166509 | A1 | 8/2005 | Sareyka et al. |
| 2008/0060306 | A1 | 3/2008 | Platt et al. |
| 2009/0223146 | A1 | 9/2009 | Platt |

FOREIGN PATENT DOCUMENTS

| | | |
|---|---|---|
| EP | 1640523 | 3/2006 |
| EP | 1775398 | 4/2007 |
| WO | WO0008269 | 2/2000 |

* cited by examiner

SPLICE PLATE

This application is a continuation in part of U.S. patent application Ser. No. 13/343,685, filed Jan. 4, 2012.

FIELD OF THE INVENTION

The present invention relates to a splice plate suitable for use in joining beams for use in a grid that supports panels and ceiling fixtures in a suspended ceiling. In particular, the present invention provides a splice plate suitable for use in joining main beams together for use in a grid that supports panels and ceiling fixtures in a suspended ceiling.

BACKGROUND

Suspended ceilings are common in many buildings and applications, including, for example, bathrooms, schools, and office buildings. They typically consist of a grid system formed by beams, and ceiling tiles that are suspended from overhead structural supports as by wires. The suspended ceilings are constructed at a job site, from the individual components, comprising main beams, cross-beams and wall angles, forming a grid. Such grid has parallel main beams that are connected by cross beams. The beams are of fixed length, for example, 12 feet, or 4 feet, or 2 feet. More than one beam may be connected together, in order to form the suspended ceiling grid of the desired dimensions.

There are various ways in which beams are connected.

For example, U.S. Pat. No. 7,788,872 B2 discloses a line of seismic main beam connections of the invention between main beams separates the ceiling into segments that move independently of each other during a quake, to limit a build-up in ceiling momentum.

In another example, U.S. Pat. No. 7,673,429 B2 discloses a ceiling system having a primary grid network which includes a plurality of grid members that are in generally perpendicular relation and form points of intersection. The ceiling system includes one or more joint clips, each of which is attached to the grid network at a point of intersection. Each joint clip partitions the primary grid network into smaller networks, which move independently of one another.

In another example, U.S. Pat. No. 7,661,236 B2 discloses a stab-in connector for a cross beam in a grid of a suspended ceiling, wherein the grid supports panels in rectangular grid openings; the connector having a top and a bottom angled flange extending outwardly at its top and at its bottom, respectively, the improvement comprising the connector with an indent, wherein the indent is formed v-shaped in the bottom angled flange with a height above the surface of the bottom angled flange.

In another example, U.S. Pat. No. 7,614,195 B2 discloses a ceiling grid for a suspended ceiling intended for use in zones subject to earthquakes, the improvement comprising a joint clip that (1) in a connection in the grid between a main beam and a pair of cross beams, each of which extends from an opposite side of the main beam, (2) permits, during an earthquake, the main beam and each of the pair of cross beams to move independently of one another, without transmitting forces between or among the beams; (3) is formed of a pair of loosely connected segments movable with respect to one another longitudinally of the main beam; and (4) has a) an overhang that extends above, and laterally across, the main beam and is slidably secured to the main beam by a cut-out in the overhang that conforms in shape generally to the cross-section of the bulb in the main beam, with a stop below the cut-out; b) an underhang on each side of the main beam integral with the overhang, that forms, with the overhang, a pocket that conforms in shape generally to the bulb and web in the cross beam, on each side of the main beam, and that extends laterally of the main beam over each cross beam, and slidably receives a cross beam, and; c) slots in each underhang that slidably receive a screw embedded in an end of the cross beam; whereby, by using a clip at connections along a selected main beam in the ceiling grid, one area of the ceiling grid is isolated from forces created in another area of the ceiling grid, during the earthquake.

In another example, U.S. Pat. No. 7,293,393 B2 discloses a perimeter clip that (a) attaches to an angle wall molding having a face and a ledge, and (b) supports a beam end in a suspended ceiling, the perimeter clip having (a) a first leg that attaches to and extends along the wall molding, and (b) a second leg that supports the beam end and that extends away from the wall molding face at a right angle to the first leg; the improvement comprising a slot in the second leg having (1) an inclined segment that extends upward and away from the first leg, and (2) a horizontal segment that extends toward the wall molding face from the inclined segment, wherein the slot receives a screw that extends through the slot into the web of the beam end being supported in the clip, with the screw being free to slide in the slot during an earthquake and support the beam end in the clip.

In another example, U.S. Pat. No. 6,957,517 B2 discloses a splice plate for a faceted curved beam formed in the field from a straight beam.

In another example, U.S. Pat. No. 6,729,100 B2 discloses a connector for a main tee of a suspended ceiling grid that has improved self-aligning and connection force properties.

In another example, U.S. Pat. No. 6,523,313 B2 discloses an end-to-end connection for main beams in a ceiling grid for a suspended ceiling.

In another example, U.S. Pat. No. 6,305,139 B2 discloses a clip for attachment to the end of a main beam for a grid in a suspended ceiling. The beam has an inverted T cross section. The clip engages an identical clip on the end of another main beam to form an end to end connection. The clip has a tongue and channel that engages with a tongue and channel in the other clip of the connection.

In another example, U.S. Pat. No. 6,178,712 B2 discloses a locking connection used to join the cross runners and main runners of a suspended grid ceiling system. The main runners are provided with periodic openings through which the cross runner ends are inserted and thereby locked together. Each cross tee end connector contains a resilient finger which engages the main runner upon insertion. Further, each connector has apertures and raised detents which will mate with those of a like opposing cross tee end connector when both are inserted through the same main runner opening. A locked grid intersection can be disengaged by depressing the resilient finger holding the main runner, rotating the main runner over the cross runner end connector, and pushing the cross tee end vertically free.

In another example, U.S. Pat. No. 6,199,343 B2 discloses a hook type assembly that interlocks a pair of intersecting cross-beams and a main beam in a grid for a suspended ceiling. A gapped ridge in a clip on each cross-beam engages the other gapped ridge in a vertical movement that is part of a hooking action while the assembly is formed.

In another example, U.S. Pat. No. 4,724,650 discloses an intersection spacer . . . for use in a subceiling structure of a grid of open-ended runner beams and intersecting open-ended cross beams.

In another example, U.S. Pat. No. 4,335,973 B2 discloses a splicer bar . . . for fastening together two inverted T-shaped runners. The splicer bar spans the junction between two runners and the splicer bar is fastened to the vertical web of both runners. Each runner has spaced apertures in its vertical web and the splicer bar has snap fasteners that will fit into these apertures to hold the two runners in parallel alignment and fixedly fastened together.

In another example, U.S. Pat. No. 4,314,432 discloses a pair of beams joinable end to end in aligned relation, each of the beams having a vertical web and lower flange at right angles thereto.

In another example, U.S. Pat. No. 4,108,563 A discloses locking connection for suspension ceiling systems.

In another example, U.S. Pat. No. 3,871,150 B2 discloses a main beam for use in a suspended ceiling system having a non-directional, integral coupling means provided at its ends.

In another example, U.S. Pat. No. 3,871,150 B2 discloses a clip structure . . . designed to snap over the flange of an existing suspended ceiling system suspension member. This clip will then accept or join with a new suspension member to help in the establishment of a second suspended ceiling system under the original suspended ceiling system of a room. To the second suspended ceiling system there is then mounted new ceiling boards to provide the ceiling with a new visible ceiling structure.

In another example, U.S. Pat. No. 3,284,977 B2 discloses an expansion splice.

In another example, U.S. Patent Application 20090223146A1 discloses a line of seismic main beam connections of the invention between main beams separates the ceiling into segments that move independently of each other during a quake, to limit a build-up in ceiling momentum. A slotted fishplate in the connection is set to keep the beam ends stable about a gap before a quake, and slidably connected about the gap during a quake.

In another example, U.S. Patent Application 20080060306A1 states "Joint clips of the invention are used in grids for suspended ceilings, at selected intersections, to create separate areas of ceiling that move independently of one another during an earthquake, to prevent a buildup of momentum in the entire ceiling."

In another example, U.S. Patent Application 20050166509A1 discloses a stab-in connector that locks with an opposing identical connector, through a slot in the main beam of a suspended ceiling grid. The connector has a cantilevered locking latch that is pivoted in an arc from the base of the connector that delays contact with the side of the slot as the connector is being stabbed into the slot.

In another example, U.S. Patent Application 20020124496A1 discloses an end-to-end connection for main beams in a ceiling grid for a suspended ceiling. A connector is formed at the end of a beam by combining a clip, fastened to the beam, with a configuration in the end of the beam. The connections are engaged to form a connection. The connection can be disengaged and reengaged.

In another example, European Patent EP1775398B1 discloses a connector for ceiling systems.

In another example, European Patent EP1640523B1 discloses a stab-in connector with expansion relief.

In another example, European Patent EP1553239B1 discloses a locking connector.

In another example, PCT Application WO2000008269A1 discloses a beam clip.

In another example, Canadian Patent Publication CA 1065572 a splice connection comprising: two generally aligned beam members each having a web means and a bead means surmounting said web means providing increased rigidity to said beam member, connecting means on adjacent ends of said web means splicing said beam members in an end-to-end relation.

To span a large room the main beams must be provided in sections which are spliced together end to end to form an abutting joint. It is difficult to produce a main beam connector that is consistently easy to assemble in the field and that will result in a reliable, sturdy and positive interconnection. Furthermore, the existing methods to splice beams frequently utilize pre-engineered splicing means that have a "male" and a "female" end, conferring a directionality to the beams, which must be followed, if the pre-engineered splicing means are to work. This may be difficult when adding a new suspended ceiling to an already existing suspended ceiling.

The present invention solves these problems by providing a joint or splice for a main beam in a suspended ceiling system which has a high degree of security and which insures a snug and precise fit between the abutting ends of a pair of beam sections. The splice of the present invention may be used with any beam, irrespective if the beam has pre-engineered splicing means. The splice of the present invention does not require pre-engineered fastening means to join main beams, and may be used on beams in either direction, or on beams without pre-engineered fastening means and provides a more secure connection than that produced by a pre-engineered fastening means. The splice plate of the present invention may also be used to splice beams of a different manufacturer together. The ability to splice together beams of different manufacturers is of particular usefulness because renovation projects and the like frequently require connecting an existing ceiling grid of one manufacturer to a new ceiling grid of a different manufacturer.

SUMMARY

In one embodiment, the present invention provides a splice plate enabling two beams for a suspended ceiling to be joined together, the beams having an inverted T-shape, with a bulb at the top, a vertical web extending downward from the bulb, and horizontal flanges at the bottom of the web, comprising:

a. a top portion and two side portions that extend downward from the top portion, wherein the top portion and the two side portions define a central channel;
b. wherein the central channel permits the two beams to be longitudinally inserted into the central channel;
c. wherein the bulbs of the two beams are located in the portion of the central channel that is defined by the top portion; and
d. wherein the webs of the beams are located in the portion of the central channel being defined by the two side portions.

In one embodiment, the present invention provides a splice plate enabling two beams for a suspended ceiling to be joined together, the beams having an inverted T-shape, with a bulb at the top, a vertical web extending downward from the bulb, and horizontal flanges at the bottom of the web, comprising:

a. a plate shaped along its longitudinal axis to form a top portion and two side portions that extend downward from the top portion, wherein the top portion and the two side portions define a central channel;
b. wherein the central channel permits the two beams to be longitudinally inserted into the central channel;
c. wherein the bulbs of the two beams are located in the portion of the central channel that is defined by the top portion; and d. wherein the webs of the beams are located in the portion of the central channel being defined by the two side portions.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person of ordinary skill in the art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein:

FIG. 1CFIG. 1 *c*) is a plan view of one embodiment of the splice plate of the present invention.

DETAILED DESCRIPTION

For clarity of disclosure, and not by way of limitation, the detailed description of the invention is divided into the following subsections that describe or illustrate certain features, embodiments or applications of the present invention.

Definitions

"Beam" as used herein refers to a "T"-shaped beam, frequently fabricated from metal that is used to form the grid of a suspended ceiling.

"Web" as used herein refers to the portion of the beam that extends down from the bulb to the flanges.

"Bulb" as used herein refers to top portion of a beam.

"Flange" as used herein refers to the lateral extension from the web on either side of the beam, on which the ceiling tiles rest.

A typical suspended ceiling consists of a grid-work of metal beams in the shape of an upside-down "T", suspended on wires from the overhead structure. These beams snap together in a regularly spaced pattern—typically a 2×2 or 2×4 feet, such as, for example, the grid disclosed in U.S. Pat. No. 6,763,642. The grid is formed by a series of longitudinal main beams, extending the length of the ceiling, that are spaced evenly apart, connected by cross-beams, forming the desired grid pattern. The grid may be filled with lightweight "tiles" or "panels" which simply drop into the grid. Tiles can be selected with a variety of materials, including wood, metal, plastic, or mineral fibers, and can come in almost any color. Light fixtures, HVAC air grilles, and other fixtures are available which can fit the same space as a the for easy installation.

Figure 5:
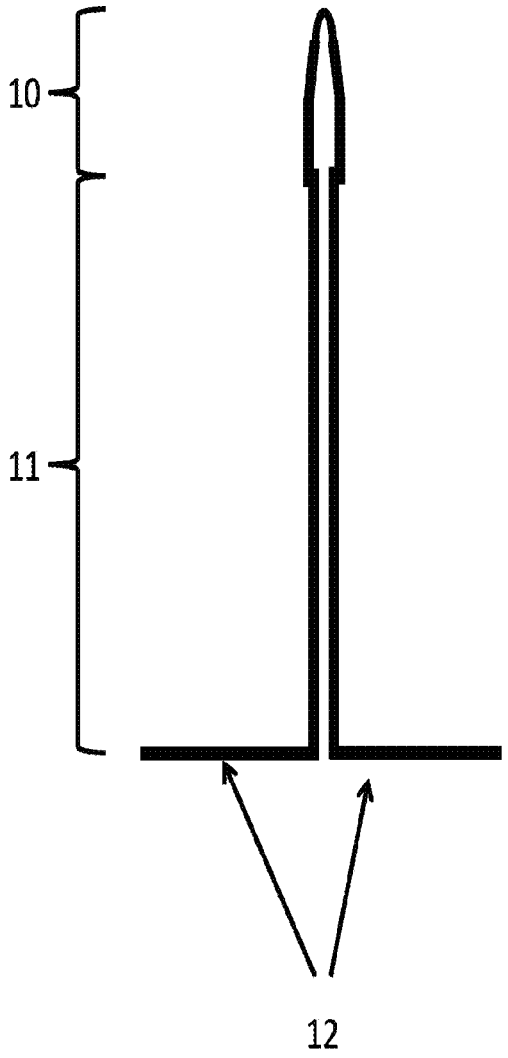
FIG. 5 is an end view of a beam suitable for used in the present invention, showing a bulb 10, a web 11, and flanges 12.

Beams that are typically used in suspended ceilings are generally of an inverted T-shape, with a bulb at the top, a vertical web extending downward from the bulb, and horizontal flanges at the bottom of the web. An example of a cross section of a beam is shown in FIG. 5. The height of a main beam from the top of the flanges to the top of the bulb is generally about 1⅝th inches. The bulb may be any shape suitable for use in the art. For example, the bulb may be square-shaped in cross-section. Alternatively, the bulb may be rounded in cross-section. Alternatively, the bulb may be arrowhead-shaped in cross section. The height of a cross-beam from the top of the flanges to the top of the bulb is generally about 1½ inches. Beams may be constructed of any suitable material. However, beams are typically formed from a flat strip of metal by folding the strip along its longitudinal center.

The choice of beam may be easily selected by one of ordinary skill in the art. For example, the beam may the beam disclosed in U.S. Pat. No. 6,722,098. Alternatively, the beam may be the beam disclosed in U.S. Pat. No. 6,138,416.

To span a large room the main beams must be provided in sections which are spliced together end to end to form an abutting joint. Such joined main beams are subjected to tension, compression, and bending stresses, and occasionally to twisting forces. The function of the splice plate of the present invention is to maintain the strength and alignment of the main beams. The splice plate of the present invention enables two main beams to be connected together in a way that provides improved strength to the junction between the main beams. The splice plate of the present invention may be used with any suspended ceiling beam.

In one embodiment, the present invention provides a splice plate that is capable of being rapidly installed, in that the two beams are rapidly joined together, using the splice plate of the present invention. In one embodiment, the splice plate of the present invention does not hinder the installation of ceiling panels after the splice plate is installed, and the beams longitudinally inserted therein are joined.

In one embodiment, the present invention provides a splice plate enabling two beams for a suspended ceiling to be joined together, the beams having an inverted T-shape, with a bulb at the top, a vertical web extending downward from the bulb, and horizontal flanges at the bottom of the web, comprising:

a. a top portion and two side portions that extend downward from the top portion, wherein the top portion and the two side portions define a central channel;
b. wherein the central channel permits the two beams to be longitudinally inserted into the central channel;
c. wherein the bulbs of the two beams are located in the portion of the central channel that is defined by the top portion; and
d. wherein the webs of the beams are located in the portion of the central channel being defined by the two side portions.

In one embodiment, the present invention provides a splice plate enabling two beams for a suspended ceiling to be joined together, the beams having an inverted T-shape, with a bulb at the top, a vertical web extending downward from the bulb, and horizontal flanges at the bottom of the web, comprising:

a. a plate shaped along its longitudinal axis to form a top portion and two side portions that extend downward from the top portion, wherein the top portion and the two side portions define a central channel;
b. wherein the central channel permits the two beams to be longitudinally inserted into the central channel;
c. wherein the bulbs of the two beams are located in the portion of the central channel that is defined by the top portion; and
d. wherein the webs of the beams are located in the portion of the central channel being defined by the two side portions.

In one embodiment, the beams are main beams.

In one embodiment, the top portion of the splice plate conforms to the shape of the outer surface of a bulb of a beam.

In one embodiment, the side portions of the splice plate conform to the shape of the outer surface of a web of a beam.

In one embodiment, the splice plate of the present invention fully extends down the web of the beams that are longitudinally inserted into the central channel.

Figure 1A:
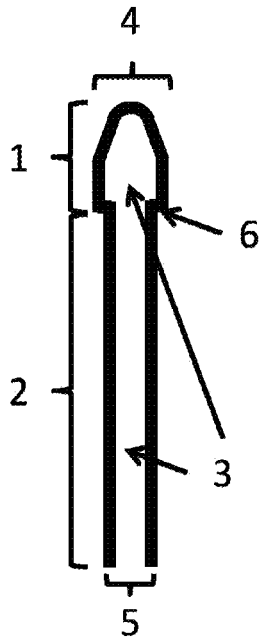
FIG. 1A is front view of one embodiment of the splice plate of the present invention.
Figure 1B:
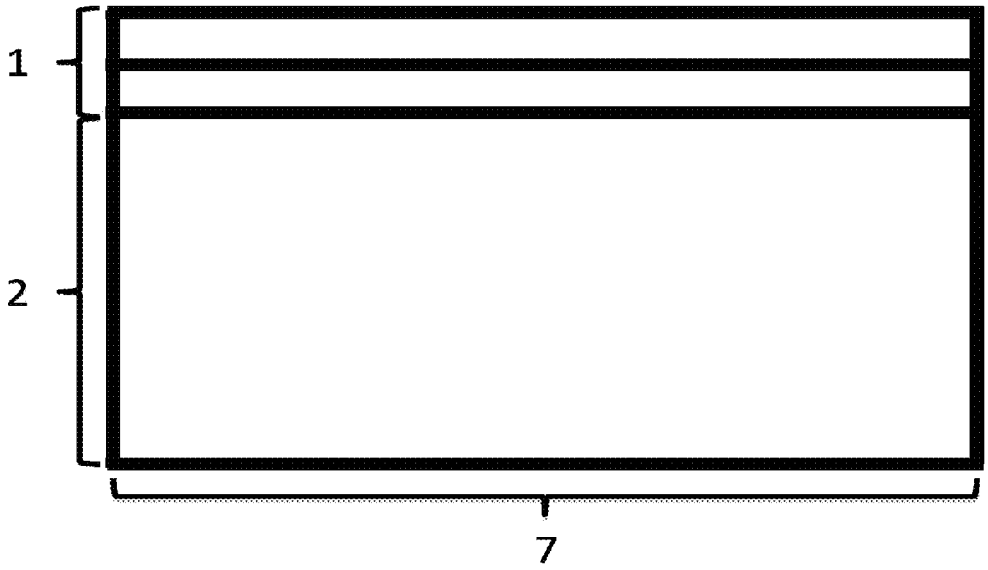
FIG. 1B is a side view of one embodiment of the splice plate of the present invention.
Figure 1C:
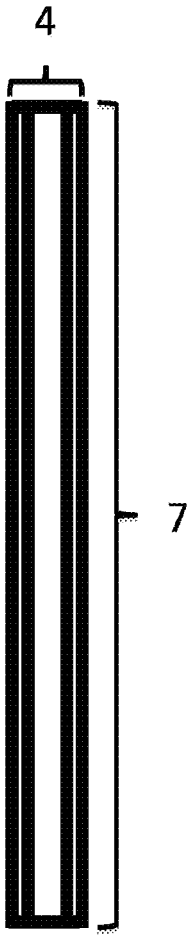
Figure 1D:
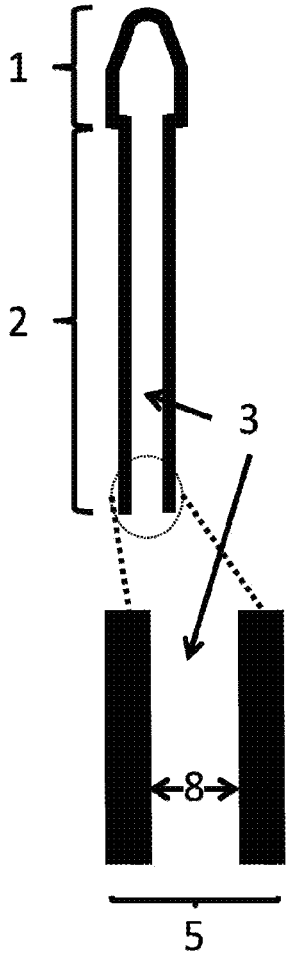
FIG. 1D is a magnified view of the bottom end of the side portions 2.
Figure 1E:
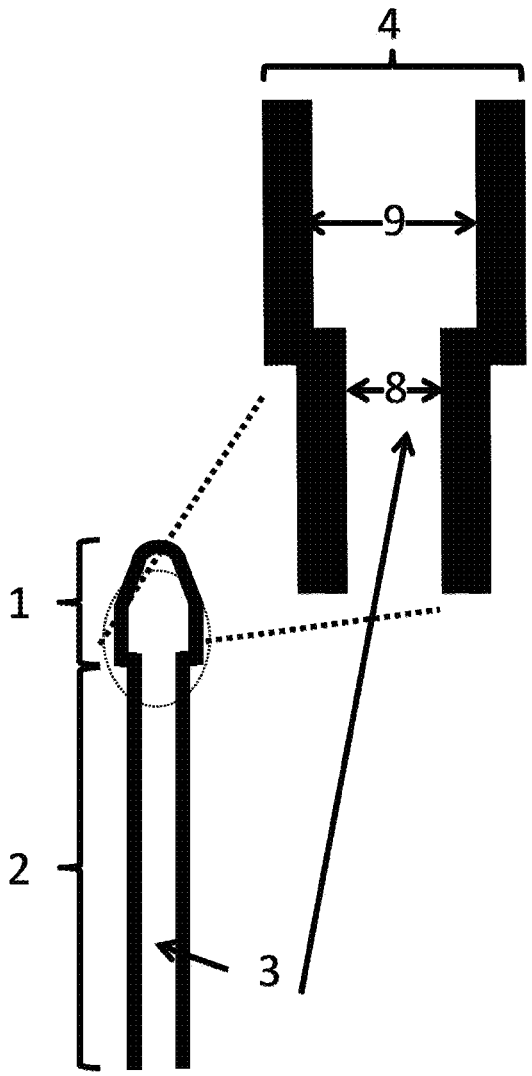
FIG. 1E is a magnified view of the top portion 1 of the splice plate of the present invention.
Figure 2A:
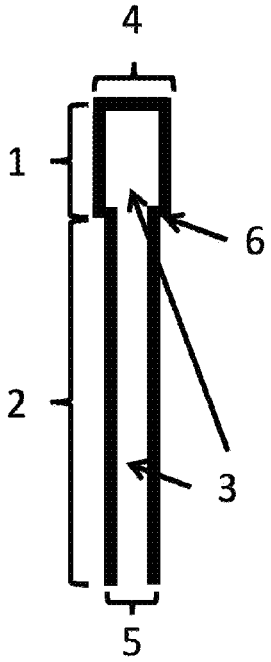
FIG. 2A is front view of an alternate embodiment of the splice plate of the present invention.
Figure 2B:
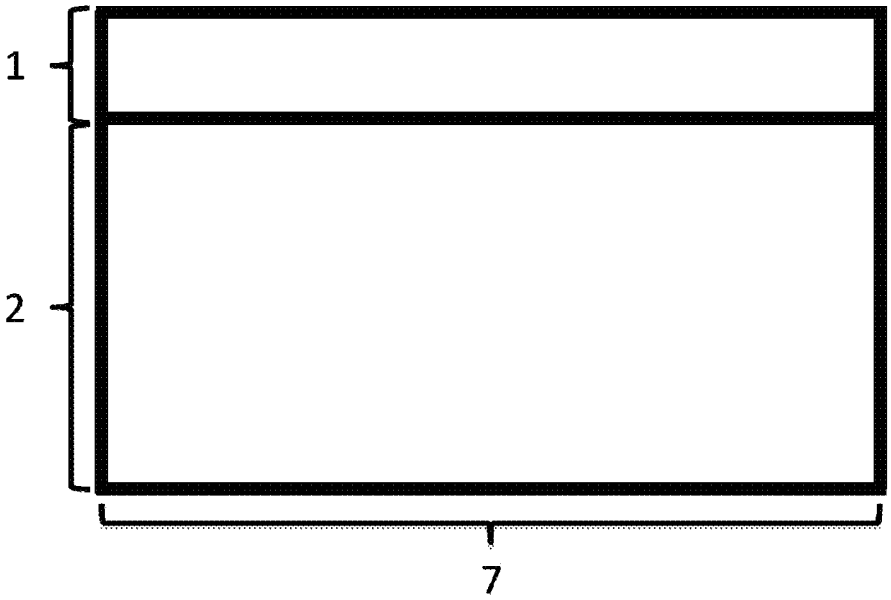
FIG. 2B is a side view of an alternate embodiment of the splice plate of the present invention.
Figure 2C:
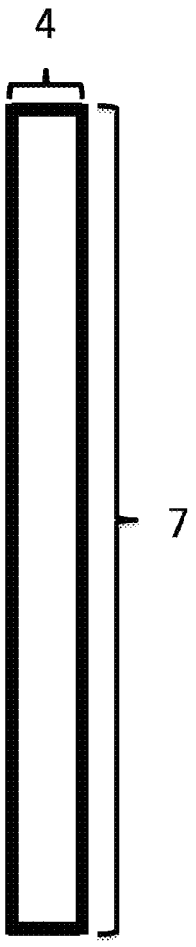
FIG. 2C is a plan view of an alternate embodiment of the splice plate of the present invention.
Figure 2D:
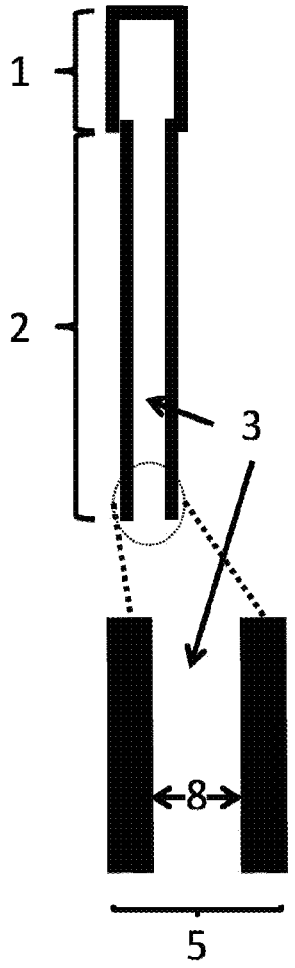
FIG. 2D is a magnified view of the bottom end of the side portions 2.
Figure 2E:
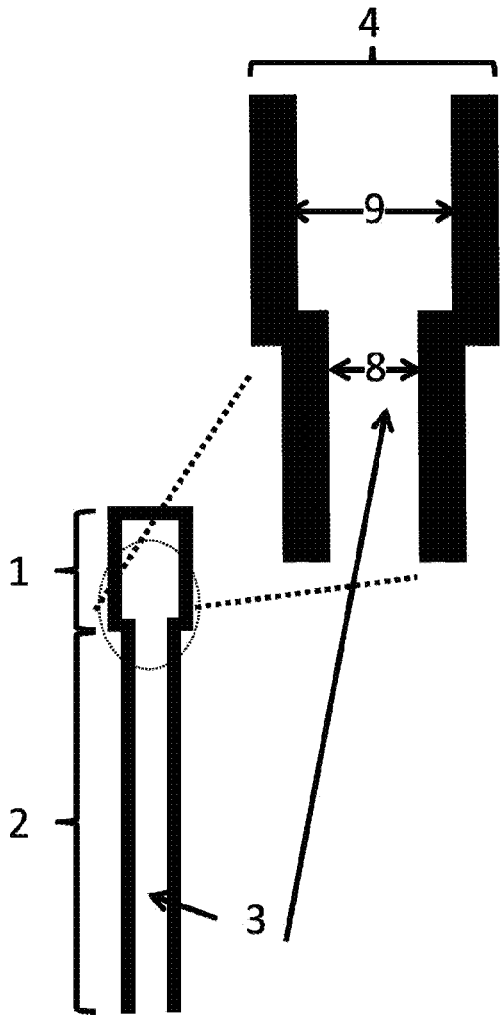
FIG. 2E is a magnified view of the top portion 1 of the splice plate of the present invention.

FIG. 1 shows one embodiment of the splice plate of the present invention. FIG. 1A is front view of one embodiment of the splice plate of the present invention, showing the top portion 1, and the side portions 2, defining a central channel 3. The top portion 1 has an outer width 4 and the side portions are separated by an outside width 5 that defines a central channel 3 that is sufficiently wide enough to permit a beam to fit therein. The top portion 1 has an indentation 6 at the bottom; where the side portions 2 begin, forming a narrow portion of the central channel 3. FIG. 1B is a side view of one embodiment of the splice plate of the present invention, showing the top portion 1, and the side portions 2, having a length 7. FIG. 1C is a plan view of one embodiment of the splice plate of the present invention, showing the top portion 1, having an outer width 4, and a length 7. FIG. 1D is a magnified view of the bottom end of the side portions 2, showing the portion of the central channel 3 defined by the two side portions 2 has an inner width 8, and an outer width 5. FIG. 1E is a magnified view of the top portion 1 of the splice plate of the present invention, wherein the portion of the central channel 3 that is defined by the two side portions 2 has an inner width 9, and an outer width 4. FIG 2 shows an alternate embodiment of the splice plate of the present invention. FIG. 2A is front view of an alternate embodiment of the splice plate of the present invention, showing the top portion 1, and the side portions 2, defining a central channel 3. The top portion 1 has an outer width 4 and the side portions are separated by an outside width 5 that defines a central channel 3 that is sufficiently wide enough to permit a beam to fit therein. The top portion 1 has an indentation 6 at the bottom; where the side portions 2 begin, forming a narrow portion of the central channel 3. FIG. 2B is a side view of an alternate embodiment of the splice plate of the present invention, showing the top portion1, and the side portions2, having a length 7. FIG. 2C is a plan view of an alternate embodiment of the splice plate of the present invention, showing the top portion 1, having an outer width 4, and a length 7. FIG. 2D is a magnified view of the bottom end of the side portions 2, showing the portion of the central channel 3 defined by the two side portions2 has an inner width 8, and an outer width 5. FIG 2E is a magnified view of the top potion 1 of an alternate embodiment of the splice plate of the present invention, wherein the portion of the central channel 3 that is defined by the two side portions 2 has an inner width 9, and an outer width 4.

In one embodiment, the splice plate of the present invention can join beams from the same manufacturer together. Alternatively, the splice plate of the present invention may join beams from different manufacturers together. The ability to splice together beams of different manufacturers is of particular usefulness because renovation projects and the like frequently require connecting an existing ceiling grid of one manufacturer to a new ceiling grid of a different manufacturer.

The splice plate of the present invention may be used with beams of any cross-sectional profile, such as, for example, rounded bulbs, square bulbs, and the like. In one embodiment, the splice plate of the present invention can join beams having the same cross-sectional profile together. Alternatively, the splice plate of the present invention may join beams having different cross-sectional profiles together. In one embodiment, the cross-sectional profile of the top portion 1 of the splice plate of the present invention matches the cross sectional profile of the beams.

Figure 6B:
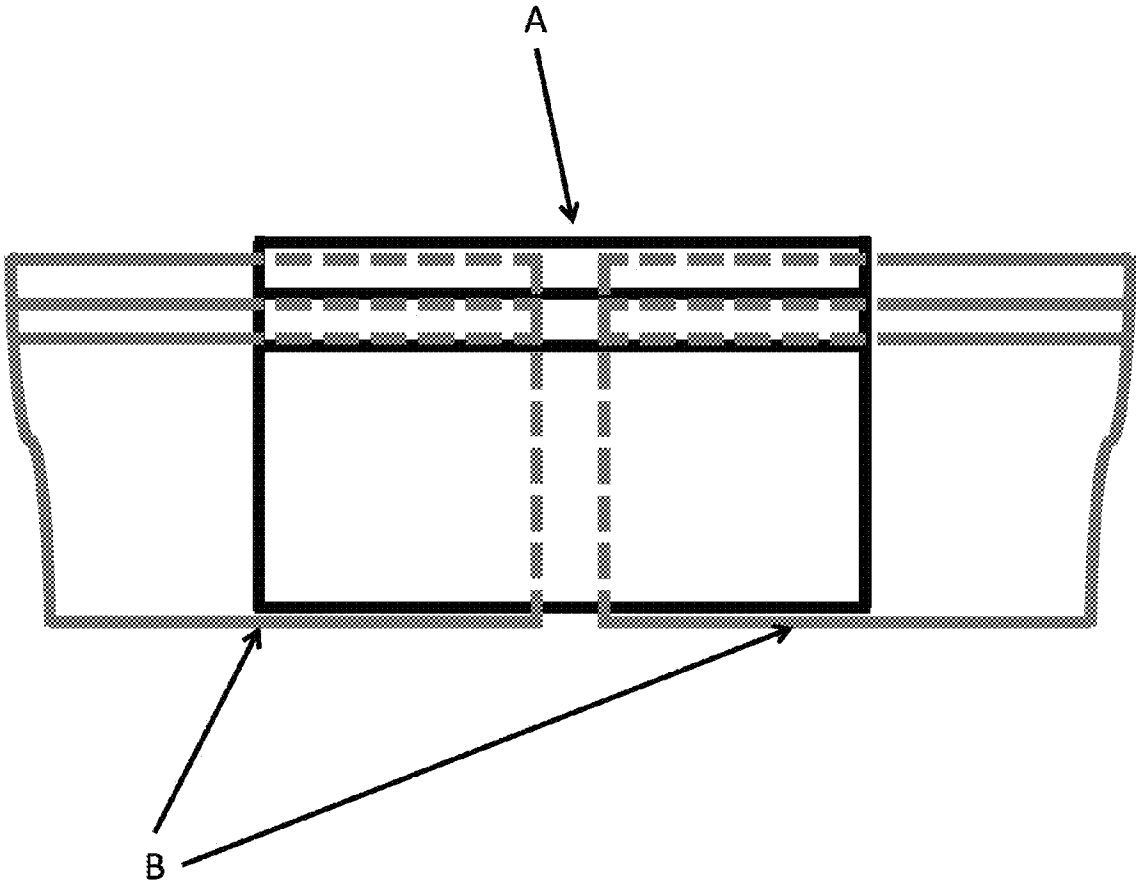
FIG. 6B is a side view of one embodiment of a splice plate of the present invention A that has two beams B longitudinally inserted into the central channel.
Figure 6A:
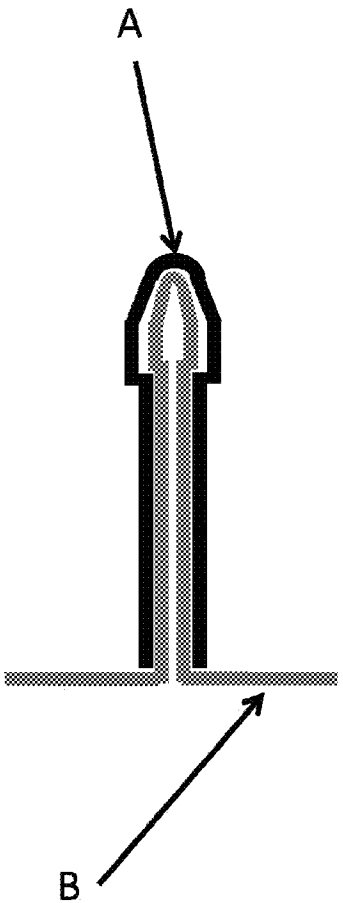
FIG. 6A is a front view of one embodiment of a splice plate of the present invention A, that has two beams B longitudinally inserted into the central channel.

FIG. 6 shows how one embodiment of the splice plate of the present invention may be utilized to join two beams together. FIG. 6A is a front view of one embodiment of a splice plate of the present invention A, that has two beams B inserted into the central channel. FIG. 6B is a side view of one embodiment of a splice plate of the present invention A that has two beams B inserted into the central channel. The length 7 of the splice plate of the present invention provides an overlap of the beams that are inserted into the central channel 3. The overlap provides the stability for the join between the beams.

In one embodiment of the present invention, the splice plate of the present invention has a top portion 1 and two side portions 2 that define a central channel 3 such that the side portions 2 and the top portion 1 form a close contact with the bulb and web of the beams that are longitudinally inserted into the central channel 3, preventing the beams from sliding out of the splice plate of the present invention. In one embodiment, the splice plate of the present invention has indentations 6 where the top portion 1 ends and the two side portions 2 begin, such that the central channel 3 that is defined by the side portions 2 is narrower than the central channel 3 that is defined by the top portion 1. In one embodiment, the side indentations 6 define a central channel 3 such that the side portions 2 and the top portion 1 form a close contact with the bulb and web of the beams that are longitudinally inserted into the central channel 3, preventing the beams from sliding out of the splice plate of the present invention.

The splice plate of the present invention may be formed of any material. In one embodiment, the splice plate of the present invention is formed from metal. In one embodiment, the splice plate is formed from the same material as the beams.

Figure 7A:
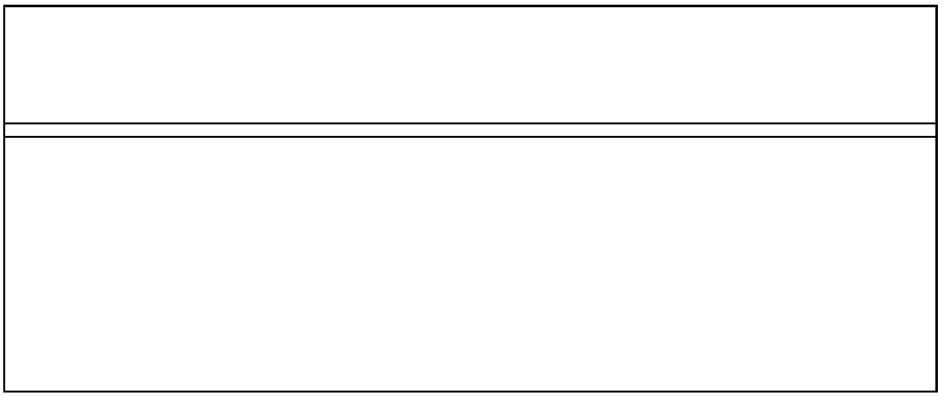
FIG. 7A shows a side-view photograph of one embodiment of a splice plate of the present invention.
Figure 7B:
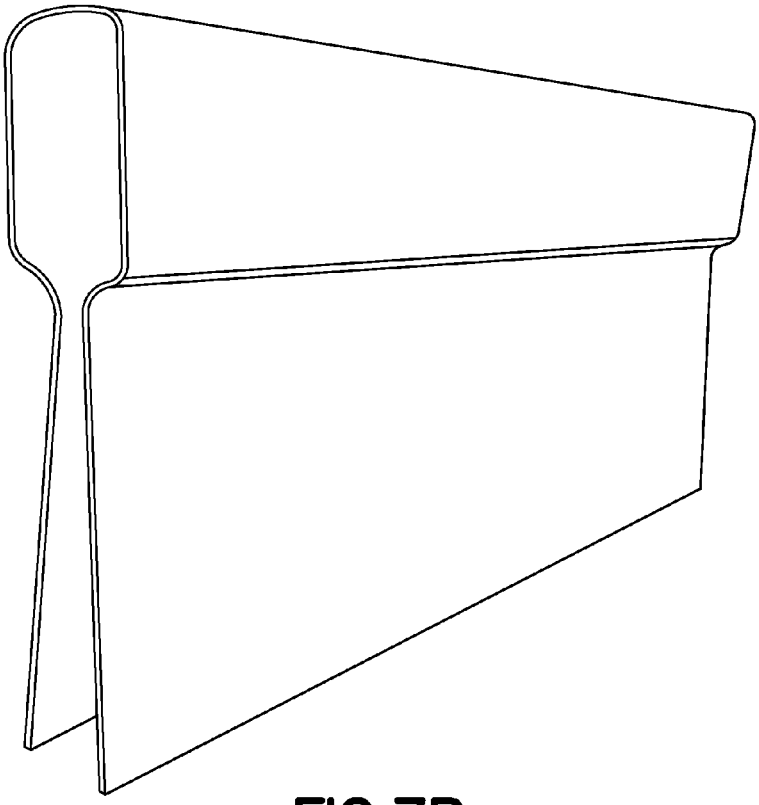
FIG. 7B shows a perspective view photograph of one embodiment of a splice plate of the present invention.
Figure 8A:
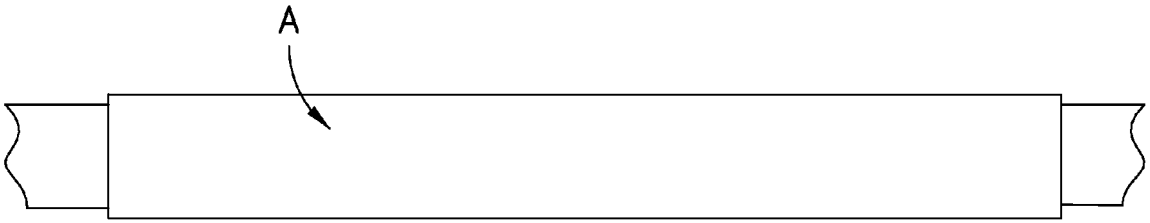
FIG. 8A shows a top-view photograph of one embodiment of a splice plate of the present invention A, that has two beams B longitudinally inserted into the central channel.
Figure 8B:
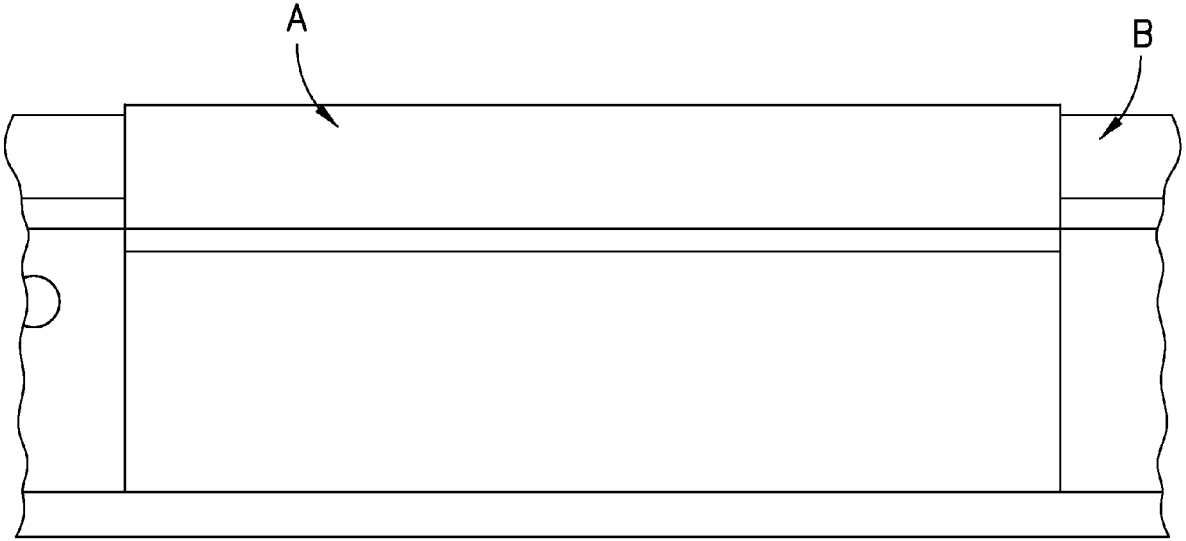
FIG. 8B shows a side-view photograph of one embodiment of a splice plate of the present invention A, that has two beams B longitudinally inserted into the central channel.

In the embodiments where the splice plate of the present invention is made from metal, the thickness or gauge of the metal may be of a sufficient gauge to maintain the strength and alignment of the main beams that are butted together. In one embodiment, the splice plate of the present invention is made from metal of a thickness from about 25-gauge (about 0.0247 inch thick) to about 18-guage (about 0.0516 inch thick). In one embodiment, the splice plate of the present invention is made from 20-gauge metal (about 0.0396 inch thick). FIG. 7 and FIG. 8 show one embodiment of the splice plate of the present invention that is made from 20-gauge metal. It is appreciated that the thickness of a given gauge varies slightly, depending on the metal. It is also appreciated that the optimal gauge and metal will be influenced by a particular application and the overall weight of the suspension, although, there is general inter-applicability.

In one embodiment, the splice plate is made such that the side portions 2 are forced open by the beams that are longitudinally inserted into the central channel 3. In one embodiment, the material forming the splice plate biases the side portions 2 to have an inner width 8 of a lesser dimension that the width of the webs of the beams that are longitudinally inserted into the central channel 3. Inserting the beams into the central channel 3 forms a spring force, keeping the side portions 2 tightly pushed against the webs of the inserted beams.

Figure 3A:
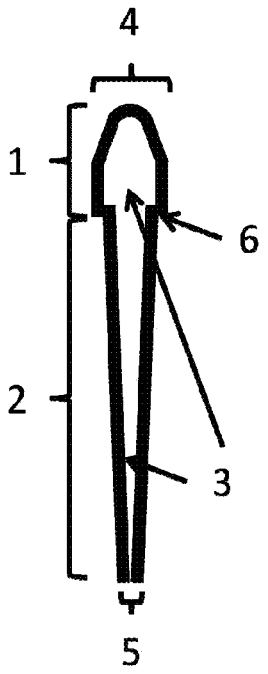
FIG. 3A is front view of an alternate embodiment of the splice plate of the present invention.
Figure 3B:
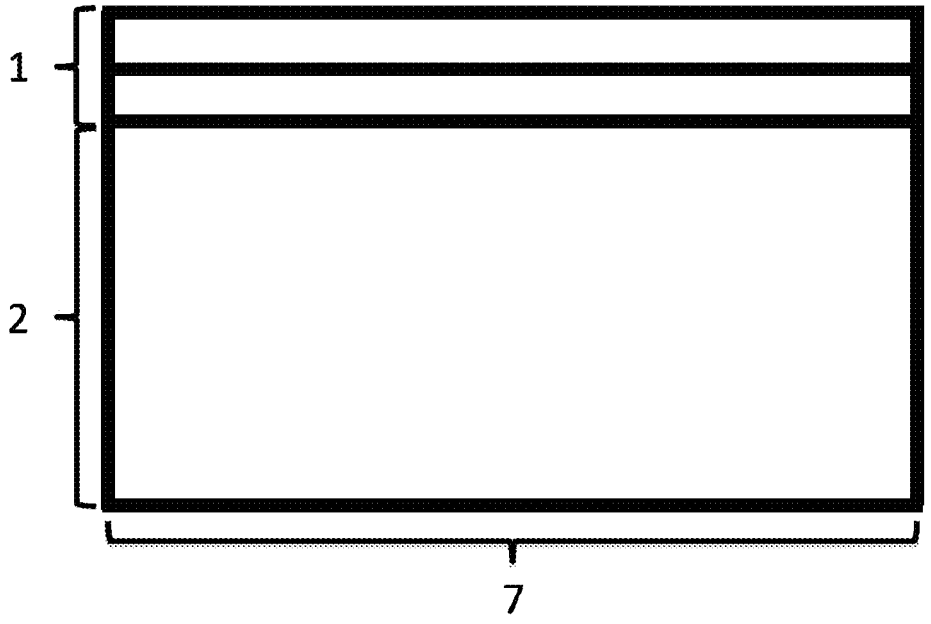
FIG. 3B is a side view of an alternate embodiment of the splice plate of the present invention.
Figure 4A:
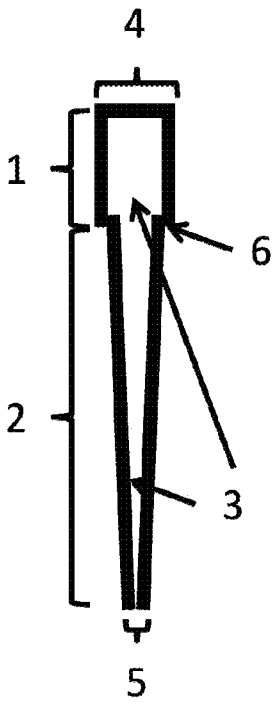
FIG. 4A is front view of an alternate embodiment of the splice plate of the present invention.
Figure 4B:
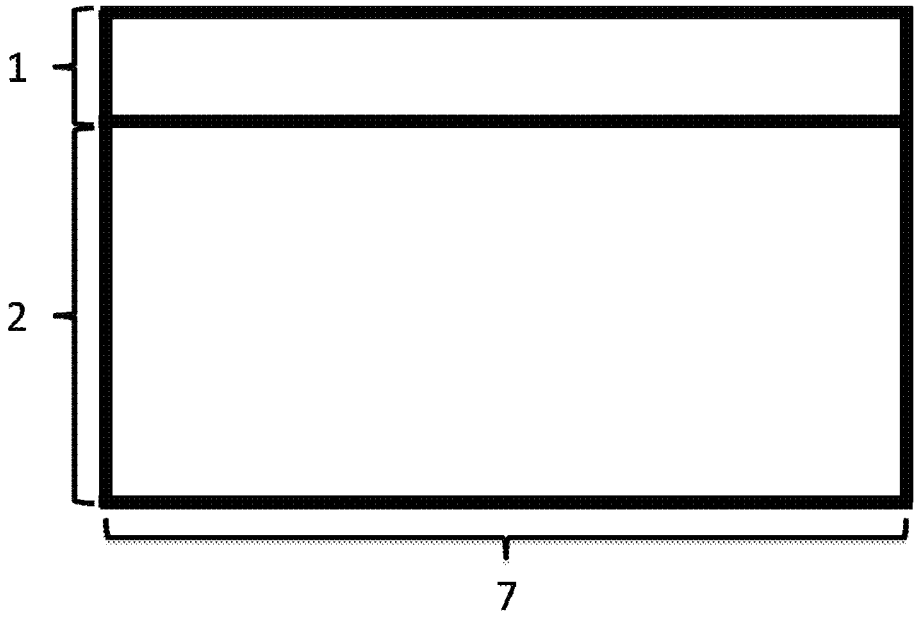
FIG. 4B is a side view of an alternate embodiment of the splice plate of the present invention.

FIG. 3 and FIG. 4 depict two embodiments of the splice plate of the present invention where the side portions 2 are formed such that the bottom-most portions are touching. In these embodiments, insertion of main beams longitudinally into the central channel 3 forces the side portions 2 apart, forming a spring force that pushes the side portions 2 against the webs of the inserted beams, such that the splice plate of the present invention does not move along the inserted main beams. FIG. 3 shows an alternate embodiment of the splice plate of the present invention. FIG. 3A is front view of the one embodiment of the splice plate of the present invention, showing the top portion 1, and the side portions 2, defining a central channel 3, wherein the bottom-most portions of the side portions 2 are touching. The top portion 1 has an outer width 4 and the side portions are separated by an outside width 5 that defines a central channel 3 that is sufficiently wide enough to permit a beam to fit therein. The top portion1 has an indentation 6 at the bottom; where the side portions 2 begin, forming a narrow portion of the central channel 3. FIG. 3B is a side view of the one embodiment of the splice plate of the present invention, showing the top portion 1, and the side portions 2, having a length 7. FIG. 4 shows an alternate embodiment of the splice plate of the present invention. FIG 4A is front view of one embodiment of the splice plate of the present invention, showing the top portion 1, and the side portions 2, defining a central channel 3, wherein the bottom-most portions of the side portions 2 are touching. The top portion 1 has an outer width 4 and the side portions are separated by an outside width 5 that defines a central channel 3 that is sufficiently wide enough to permit a beam to fit therein. The top portion 1 has an indentation 6 at the bottom; where the side portions 2 begin, forming a narrow portion of the central channel 3. FIG. 4B is a side view of one embodiment of the splice plate of the present invention, showing the top portion 1, and the side portions 2, having a length 7.

The splice plate of the present invention may be shaped by any suitable method selected by one of ordinary skill in the art. For example, the splice plate of the present invention may be shaped by casting the splice plate using a mold. Alternatively, the splice plate of the present invention may be shaped using a die cast shaping method. Alternatively, the splice plate of the present invention may be shaped by folding a flat material into the desired shape.

The central channel 3 defined by the top portion 1 and the side portions 2 may be of any dimension that permits a beam to be inserted into the central channel 3. In one embodiment, the width of the portion of the central channel 3 defined by the top portion 1 is the same as the width of the central channel 3 defined by the side portions 2. In an alternate embodiment, the width of the central channel 3 defined by the side portions 2 is less than the width of the central channel 3 defined by the top portion 1. In the embodiments where the width of the central channel 3 defined by the side portions 2 is less than the width of the central channel 3 defined by the top portion 1, the decrease in width of the width of the central channel 3 defined by the side portions 2 may be achieved by the use of indentations 6.

The outer width of the top portion 4 and the outer width of the side portions 5 may be varied to permit beams of various dimensions to be inserted. For example, in one embodiment, the outer width of the top portion 4 may be from about 0.3619 inch to about 0.6032 inch. Alternatively, the outer width of the top portion 4 may be from about 0.3917 inch to about 0.5167 inch. Alternatively, the outer width of the top portion 4 may be about 0.3917 inch. In one embodiment, the outer width of the top portion 4 may be the inner width of the top portion 9 plus twice the thickness of the material used to form the splice plate of the present invention.

In one embodiment, the outer width of the side portions 5 may be from about 0.1119 inch to about 0.6032 inch. Alternatively, the outer width of the side portions 5 may be from about 0.3917 inch to about 0.5167 inch. Alternatively, the outer width of the side portions 5 may be about 0.3917 inch. In one embodiment, the outer width of the side portions 5 may be the inner width of the side portions 8 plus twice the thickness of the material used to form the splice plate of the present invention.

The inner width of the top portion 9 and the inner width of the side portions 8 may be varied to permit beams of various dimensions to be inserted. In both cases, the inner width of the central channel would be the width of the respective outer portion, less twice the thickness of the material used to form the splice plate of the present invention. For example, in one embodiment, the inner width of the top portion 9 may be from about $5/16^{th}$ (or 0.3125) inch to about ½ (or 0.5) inch. Alternatively, the inner width of the top portion 9 may be from about $5/16^{th}$ (or 0.3125) inch to about $7/16^{th}$ (or 0.4375) inch. Alternatively, the inner width of the top portion 9 may be about $5/16^{th}$ (or 0.3125) of an inch.

Similarly, the inner width of the side portion 8 may be from about $1/16^{th}$ (or 0.0625) inch to about $8/16^{th}$ (or 0.5) inch. Alternatively, the inner width of the side portion 8 may be from about $1/16^{th}$ (or 0.0625) inch to about $3/16^{th}$ (or 0.1875) inch. Alternatively, the inner width of the side portion 8 may be about $1/16^{th}$ (or 0.0625) inch.

The central channel 3 may be any shape suitable for accepting a beam. For example, in one embodiment, such as, for example, the embodiment shown in FIG. 1 and FIG. 2, the central channel 3 has a top portion 1, with indentations 6 on either side, creating a narrower portion of the central channel 3 formed by the side portions 2.

The top portion 1 may be, for example, arrow-shaped, U-shaped, and the like. The Top portion may have indentations 6, or the indentations 6 may be absent.

In one embodiment, the height of the top portion 1 may be from about 0.5 inch to about ¾ inch. Alternatively, the height of the top portion 1 may be from about 0.5 inch to about $^{11}/_{16}{}^{th}$ inches. Alternatively, the height of the top portion 1 may be about $^{11}/_{16}{}^{th}$ inch.

In one embodiment, the length of the side portions 2 may be from about $^{7}/_{8}{}^{th}$ inch to about $1^{1}/_{16}{}^{th}$ inches. Alternatively, the length of the side portions 2 may be from about ¾ inch to about $1^{1}/_{16}{}^{th}$ inches. Alternatively, the length of the side portions 2 may be about one inch. In one embodiment, the side portions 2 extend down to touch the flanges of the beams inserted into the central channel 3.

The length 7 of the splice plate of the present invention may be of any length sufficient to provide a stable joint between the beams inserted into the central channel 3. For example, the length 7 of the splice plate of the present invention may be from about 3 inches to about 8 inches. Alternatively, the length 7 of the splice plate of the present invention may be from about 4 inches to about 6 inches. Alternatively, the length 7 of the splice plate of the present invention may be about 5¾ inches.

In one embodiment, the stability for the join between the beams is enhanced by the use of fasteners that are inserted through the side portions 2 of the splice plate of the present invention and through the web of the beams B.

In one embodiment, the stability of the join between the beams is enhanced by the use of fasteners that are inserted through the top portion 1 of the splice plate of the present invention and through the bulb of the beams B.

The splice plate of the present invention may also contain holes, or indentations wherein the fasteners may be inserted, thus affixing the splice plate of the present invention to the beams inserted into the central channel. In one embodiment, the fasteners are selected from the group consisting of adhesive, screws, rivets, wire, nails and bolts. However, any fastener may be used.

In one embodiment, the splice plate of the present invention has one or more side arms, allowing cross-beams to be connected to main beams, forming the grid pattern of a suspended ceiling. In these embodiments, the one or more side arms are shaped to form top portion that conforms to the outer surface of the bulb portion of the cross-beams, and have two side portions extending downward from the top portion, one on either side of a central channel, which are shaped to conform to the outer surface of the web portion of the cross-beams; the top portion and the side portions being folded to permit the cross-beams to be longitudinally inserted between the two side portions, with the bulb being in the top portion of the plate, and the web being in the central channel the two side portions.

Publications cited throughout this document are hereby incorporated by reference in their entirety. Although the various aspects of the invention have been illustrated above by reference to examples and preferred embodiments, it will be appreciated that the scope of the invention is defined not by the foregoing description but by the following claims properly construed under principles of patent law.

What is claimed is:

1. A splice plate consisting of:

a linear central channel that is defined by a top portion having an inner and outer surface, and two side portions having an inner and outer surface, that extend downward from the top portion to form two distal ends that touch, wherein the splice plate is a single piece of material, wherein the central channel has an inner width, defined by the inner surfaces of the top and side portions, wherein the inner surface of the side portions forming the central channel consist of a continuous, flat surface, wherein the splice plate is configured to splice two main beams of a suspended ceiling together end-to-end, wherein the splice consists of the two main beams and the splice plate, wherein the two main beams that are to be spliced together have an inverted T-shape, with a bulb at the top of the beam, a vertical web extending downward from the bulb, and horizontal flanges at the bottom of the web, wherein the distance that the side portions of the splice plate extend downward is a distance equal to the vertical webs of the main beams that are to be spliced together, wherein the entire inner surface of the side portions is configured to contact the vertical webs of the main beams that are to be spliced together, wherein the top portion has a first inner width and indentations at the junction of the top portion and the side portions, wherein the indentations form a narrowing of the central channel, defining a central channel that is configured to form a close contact between the webs of the two main beams and the inner surface of the side portions, wherein the splice plate is configured for insertion of the main beams longitudinally into the central channel to cause the web of the beams to force the side potions apart, thereby forming a spring force, and wherein the spring force is applied to the vertical webs of the main beams that are to be spliced together by the entire inner surface of the side portions forming the central channel;

and wherein the splice plate is lacking any detents, teeth or holes.

2. The splice plate of claim 1, wherein the splice plate is metal.

3. The splice plate of claim 1, wherein the top portion is shaped to conform to the outer surface of the bulb.

4. The splice plate of claim 1, wherein the side portions are shaped to conform to the webs of the main beams.

* * * * *